US009925655B2

(12) United States Patent
Sterling

(10) Patent No.: US 9,925,655 B2
(45) Date of Patent: Mar. 27, 2018

(54) MUFFLER FOR PNEUMATIC POWER TOOL AND PNEUMATIC POWER TOOL INCORPORATING THE SAME

(71) Applicant: EXHAUST TECHNOLOGIES, INC., Jupiter, FL (US)

(72) Inventor: Robert E. Sterling, Colbert, WA (US)

(73) Assignee: Exhaust Technologies, Inc., Melville, NY (US)

( * ) Notice: Subject to any disclaimer, the term of this patent is extended or adjusted under 35 U.S.C. 154(b) by 0 days.

(21) Appl. No.: 15/302,839

(22) PCT Filed: Apr. 7, 2015

(86) PCT No.: PCT/US2015/024661
§ 371 (c)(1),
(2) Date: Oct. 7, 2016

(87) PCT Pub. No.: WO2015/157245
PCT Pub. Date: Oct. 15, 2015

(65) Prior Publication Data

US 2017/0028544 A1 Feb. 2, 2017

Related U.S. Application Data

(60) Provisional application No. 61/976,431, filed on Apr. 7, 2014.

(51) Int. Cl.
*B25D 17/12* (2006.01)
*F01N 1/10* (2006.01)
(Continued)

(52) U.S. Cl.
CPC ..... *B25F 5/00* (2013.01); *B25D 17/12* (2013.01); *F01N 3/0212* (2013.01); *G10K 11/161* (2013.01)

(58) Field of Classification Search
CPC ... F01N 1/08; F01N 1/10; F01N 1/006; F01N 1/081; F01N 1/082; B25C 7/00;
(Continued)

(56) References Cited

U.S. PATENT DOCUMENTS 1,953,264 A * 4/1934 Rauen ..... F01N 1/08 181/264
2,008,964 A * 7/1935 Mikulie ..... F01N 1/08 181/255
(Continued)

FOREIGN PATENT DOCUMENTS

CH 573045 A5 * 2/1976 ..... F01N 1/026
CN 201249439 Y 6/2009
(Continued)

OTHER PUBLICATIONS

PCT Search Report issued in corresponding application No. PCT/US2015/024861 dated Jun. 29, 2015.
(Continued)

*Primary Examiner* — Edgardo San Martin
(74) *Attorney, Agent, or Firm* — Carter, DeLuca, Farrell & Schmidt, LLP

(57) ABSTRACT

A muffler assembly for a pneumatic power tool includes a tube member defining an interior volume. The tube member includes an upper segment and a lower segment. The upper segment defines a first diameter and includes a closed upper end to inhibit fluid communication with the interior volume therethrough, a lower end, a first portion defining a plurality of vents to enable fluid communication with the interior volume therethrough, and a second portion defining a continuous surface to inhibit fluid communication with the interior volume therethrough. The lower segment defines a second diameter greater than the first diameter and includes an upper end in fluid communication with the lower end of the upper segment, a lower end, a first portion defining a
(Continued)

plurality of vents to enable fluid communication with the interior volume therethrough, and a second portion defining a continuous surface to inhibit fluid communication with the interior volume therethrough.

15 Claims, 4 Drawing Sheets

(51) Int. Cl.

| | |
|---|---|
| ***B25F 5/00*** | (2006.01) |
| ***G10K 11/16*** | (2006.01) |
| ***F01N 3/021*** | (2006.01) |
| *B25D 17/11* | (2006.01) |
| *F01N 1/08* | (2006.01) |
| *B25F 5/02* | (2006.01) |

(58) Field of Classification Search
CPC B25C 1/04; B25D 17/11; B25D 17/12; B25F 5/02; B25F 5/006; B27C 3/08
See application file for complete search history.

(56) References Cited

U.S. PATENT DOCUMENTS

| | | | | | |
|---|---|---|---|---|---|
| 2,065,343 | A * | 12/1936 | Mitchell | F01N 1/082 | 181/256 |
| 3,710,891 | A * | 1/1973 | Flugger | F01N 1/10 | 181/256 |
| 4,045,157 | A * | 8/1977 | Peterson | F23C 7/00 | 181/256 |
| 4,049,076 | A * | 9/1977 | Murphy | B25D 17/12 | 181/224 |
| 4,192,402 | A * | 3/1980 | Nakagawa | F01N 1/04 | 181/256 |
| 4,884,657 | A * | 12/1989 | Osada | F01N 1/082 | 181/239 |
| 5,109,950 | A * | 5/1992 | Lescher | F01N 1/06 | 181/256 |
| 5,214,254 | A * | 5/1993 | Sheehan | F01N 1/06 | 181/241 |
| 5,418,339 | A * | 5/1995 | Bowen | B25D 17/12 | 173/2 |
| 5,434,374 | A * | 7/1995 | Hsueh | F01N 1/12 | 181/227 |
| 5,847,334 | A * | 12/1998 | Taga | B25B 21/02 | 181/230 |
| 5,909,016 | A * | 6/1999 | Sterling | B23B 47/00 | 173/DIG. 2 |
| 6,209,678 | B1 * | 4/2001 | Sterling | B25F 5/00 | 181/230 |
| 6,332,511 | B1 * | 12/2001 | Parlato | F01N 1/085 | 181/252 |
| 6,668,971 | B2 * | 12/2003 | Sterling | B23B 47/00 | 181/229 |
| 6,926,117 | B2 * | 8/2005 | Sterling | B23B 47/00 | 181/222 |
| 7,216,739 | B2 * | 5/2007 | Sterling | B23B 47/00 | 173/DIG. 2 |
| 7,506,722 | B2 * | 3/2009 | Emler | F01N 1/003 | 181/212 |
| 7,677,357 | B2 * | 3/2010 | Shimomura | F01N 1/08 | 181/247 |
| 9,687,058 | B2 * | 6/2017 | Atkinson | A45D 20/122 | |
| 2005/0039934 | A1 * | 2/2005 | Jansson | B25F 5/00 | 173/169 |
| 2005/0103566 | A1 * | 5/2005 | Sterling | B23B 47/00 | 181/230 |
| 2008/0308348 | A1 * | 12/2008 | Bushell | F01N 1/083 | 181/254 |
| 2009/0294211 | A1 * | 12/2009 | Roberts | B25D 17/12 | 181/230 |

FOREIGN PATENT DOCUMENTS

| | | | | |
|---|---|---|---|---|
| DE | 3711029 | A1 * | 10/1987 | F01N 1/08 |
| JP | 05202731 | A * | 8/1993 | |
| JP | 2004-074299 | A | 3/2004 | |
| WO | WO 2009107375 | A1 * | 9/2009 | F01N 1/003 |

OTHER PUBLICATIONS

Supplementary EP Search Report issued in corresponding EP Application No. 15777277 dated Oct. 17, 2017 (3 pages).

* cited by examiner

MUFFLER FOR PNEUMATIC POWER TOOL AND PNEUMATIC POWER TOOL INCORPORATING THE SAME

CROSS-REFERENCE TO RELATED APPLICATIONS

This application claims the benefit of, and priority to, U.S. Provisional Patent Application No. 61/976,431, filed on Apr. 7, 2014, the entire contents of which are incorporated herein by reference.

BACKGROUND

Technical Field

The present disclosure relates to power tools and, more particularly, to a muffler for a pneumatic power tool.

Background of Related Art

Pneumatic power tools, e.g., ratchets, drills, wrenches, grinders, sanders, and the like, are commonly used in industrial and residential settings. Such tools typically include a hollow handle defining a chamber that provides an inlet and exit conduit for the high pressure air that powers the tool motor. The chamber includes an air intake passage and an air exhaust passage. Each passage extends between the motor and an opening in or near the bottom surface of the handle. The portion of the intake passage located near the handle opening typically includes a standard air coupler or the like. The coupler is adapted to connect to a pressurized air source. The exhaust passage typically opens to the atmosphere. When exhaust air is vented from the power tool, a considerable amount of noise and particulate debris are generated, potentially causing auditory and/or respiratory damage to the operator and others located nearby.

Although earplugs and facemasks are often available, they are not always used. Numerous attempts have been made by power tool manufacturers to therefore reduce the amount of noise and particles generated by the power tool itself. These attempts include designing quieter and cleaner motors and designing power tool components that suppress noise and trap waste prior to expulsion from the power tool. For example, U.S. Pat. No. 5,418,339, which is hereby incorporated herein by reference, describes a pneumatic power tool having an exhaust port filled with a web of nonwoven fibers coated with a binder resin. Other mufflers for pneumatic power tools are disclosed in U.S. Pat. Nos. 7,216,739; 6,926,117; 6,668,971; 6,209,678; and 5,909,016, all of which are hereby incorporated herein by reference.

Despite advances in muffling technology, such as those detailed in the above-noted U.S. Patents, a continuing need exists for improvements in noise muffling systems that can reduce sound levels and remove entrained contaminates from exhausted air while eliminating or limiting negative effects on performance of the pneumatic tool.

SUMMARY

To the extent consistent, any of the aspects and features described herein may be used in conjunction with any or all of the other aspects and features described herein.

In accordance with aspects of the present disclosure, a muffler assembly for a pneumatic power tool is provided including a tube member defining an interior volume. The tube member includes an upper segment defining a first diameter and a lower segment defining a second diameter greater than the first diameter. The upper segment includes a closed upper end to inhibit fluid communication with the interior volume therethrough, a lower end, a first portion defining a plurality of vents to enable fluid communication with the interior volume therethrough, and a second portion defining a continuous surface to inhibit fluid communication with the interior volume therethrough. The lower segment includes an upper end in fluid communication with the lower end of the upper segment, a lower end, a first portion defining a plurality of vents to enable fluid communication with the interior volume therethrough, and a second portion defining a continuous surface to inhibit fluid communication with the interior volume therethrough.

In an aspect of the present disclosure, the muffler assembly further includes a filter panel configured to wrap around both the upper and lower segments of the tube member.

In another aspect of the present disclosure, at least one flange extends radially outwardly from an exterior surface of the tube member. The at least one flange is configured to define a channel between the filter panel and the exterior surface of the tube member. The at least one flange may extend longitudinally the length of the tube member.

In still another aspect of the present disclosure, a receptacle is disposed at the lower end of the lower segment of the tube member in fluid communication therewith. In such aspects, a diffuser panel may be disposed within the receptacle.

In yet another aspect of the present disclosure, the first portion of the upper segment is positioned towards the upper end of the upper segment and the second portion of the upper segment is positioned towards the lower end of the upper segment. Additionally or alternatively, the first portion of the lower segment may be positioned towards the upper end of the lower segment while the second portion of the lower segment is positioned towards the lower end of the lower segment.

In still yet another aspect of the present disclosure, the first portion of the upper segment extends less than or equal to one-half of a length of the upper segment and/or the first portion of the lower segment extends less than or equal to one-half of a length of the lower segment.

A pneumatic power tool provided in accordance with aspects of the present disclosure includes a housing and a muffler assembly. The housing defines an inlet passage and an exhaust passage. The muffler assembly is configured for insertion into the exhausted passage of the housing. The muffler assembly may further be configured similar to any of the aspects detailed above.

BRIEF DESCRIPTION OF THE DRAWINGS

Various aspects and features of the present disclosure are described herein with reference to the drawings wherein.

DETAILED DESCRIPTION

Figure 8:
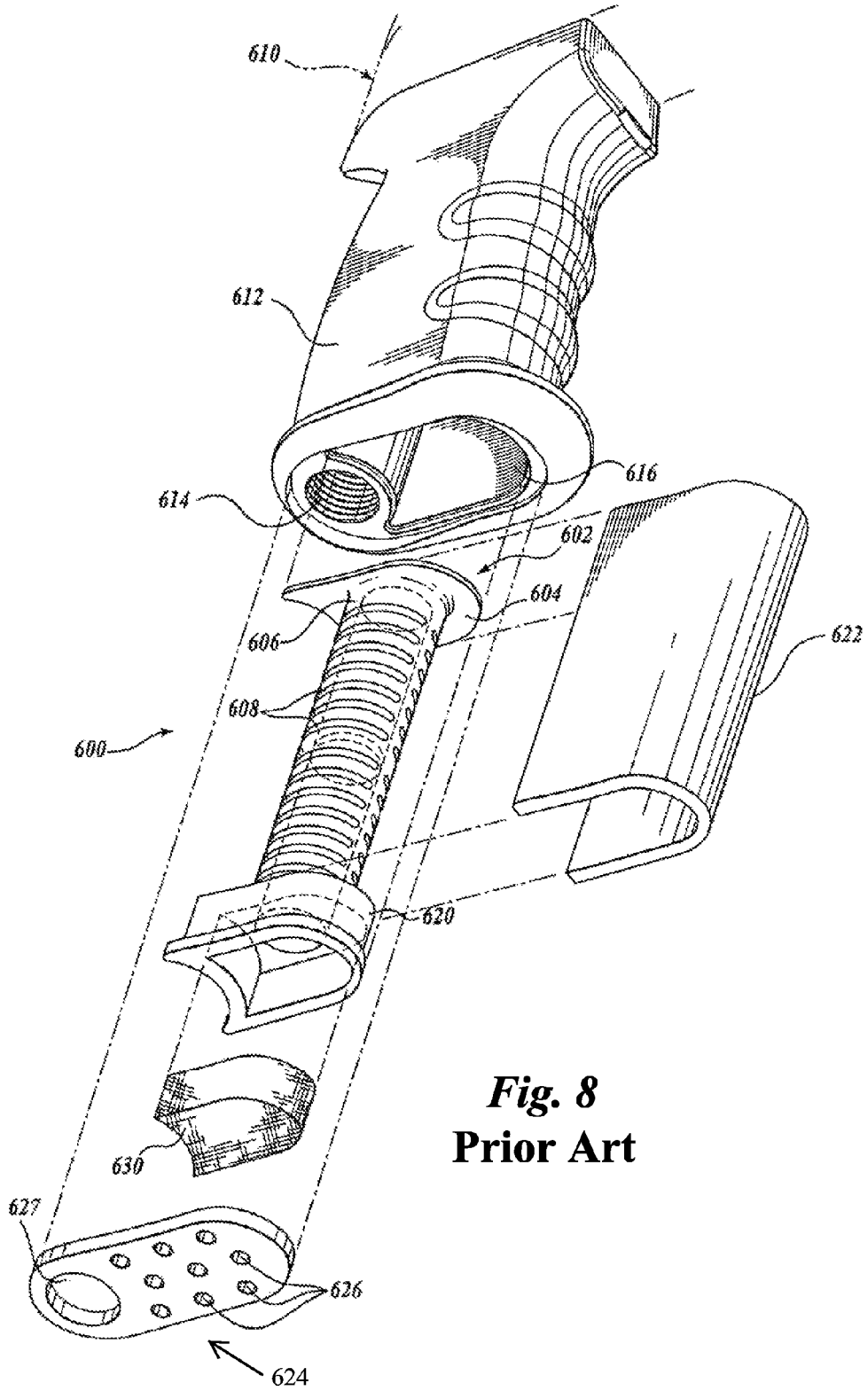
Fig. 8 Prior Art
FIG. 8 is a perspective exploded view of a prior art muffler assembly configured for use with a handgrip of a power tool.

Referring initially to FIG. 8, a prior art muffler assembly 600 as disclosed in U.S. Pat. No. 7,216,739 (previously incorporated herein by reference) is shown in connection with a handle 612 of a power tool 610. The muffler assembly 600 includes a tube member 602 having an upper flange 604 that is configured to be slidably inserted into an exhaust passage 616 provided in the handle 612 of the power tool 610. A tubular portion 606 extends downwardly from the flange 604. The tubular portion 606 includes a number of apertures 608 distributed along its length. An oversized, downwardly opening receptacle 620 is disposed at the lower end of the tubular portion 606. The receptacle 620 is also configured to be slidably insertable into the exhaust passage 616, which is adjacent the inlet passage 614. A flexible filter panel 622 is generally wrapped about the tubular portion 606 of the tube member 602, and a diffuser panel 630 is inserted into the receptacle 620.

The upper flange 604 at the upper end of the tube member 602 and the receptacle 620 at the lower end of the tube member 602 are preferably configured to approximately conform to the shape of the exhaust passage 616, such that the tube member 602 slides smoothly into the exhaust passage 616 and is maintained in a desired position therein. The tubular portion 606, which is smaller in the transverse dimension than the upper flange 604 and receptacle 620, is thereby positioned generally away from the walls of the exhaust passage 616, providing a space for exhaust airflow and for the filter panel 622.

The tube member 602 is formed integrally from a rigid or semi-rigid polymeric material, although other suitable materials may be used, including, for example, relatively soft metals, composite materials, or the like.

The flexible, sound-dampening and/or air-filtering panel 622 may be formed from any suitable porous filter material, including, for example, felt, gauze, foam, fiber, synthetics, etc. The filter panel 622 is selected of a density and composition sufficient to dampen noise in the exhaust flow, while also being sufficiently porous that the exhaust air can pass therethrough without unduly increasing backpressure in the power tool 610 during use. The filter panel 622 is disposed about the tubular portion 606 of the tube member 602, between the upper flange 604 and the receptacle 620.

The filter panel 622 is between about one-eighth inch and about one-half inch in thickness and is flexible, such that the panel 622 may be conveniently wrapped around the tubular portion 606 and does not extend significantly beyond the upper flange 604. The panel 622 maybe attached to the tubular portion 606 in any convenient manner for example, by selective application of an adhesive, a latching mechanism (not shown) disposed on the panel 622 (such as a hook-and-loop material), or a separate strap, string, wire, or tape (not shown) that wraps around the panel 622. Alternatively, the panel 622 may be formed having a generally C-shaped cross section, and having sufficient stiffness to retain itself on the tube member 602. It will be appreciated that the panel 622 may alternatively be wrapped about the tubular portion 606 without fastening and inserted into the exhaust passage 616, such that the exhaust passage 616 cooperatively retains the panel 622 in the desired position.

The diffuser panel 630 is configured to be slidably inserted into the receptacle 620, the diffuser panel 630 being made from a relatively porous material such as a spacer fabric or similar porous material. The diffuser panel 630 provides additional sound dampening just prior to the exhaust air exiting the exhaust passage 616.

The tubular portion 606 of the tube member 602 includes a blocking panel (shown in hidden lines and not specifically identified) disposed between the upper and lower ends of the tube member 602.

The muffler assembly 600 is inserted into the exhaust passage 616 of the handle 612, and an end cap 624 having one or more apertures 626 is secured over the exhaust passage 616 exit, to releasably secure the muffler assembly 600 therein. The end cap 624 may be attached by any suitable mechanism. The end cap 624 also includes an aperture 627 disposed over the inlet passage 614 opening to accommodate a coupling to a compressed air source (not shown).

The muffler assembly 600 receives at least most of the exhaust air from the power tool 610, which is directed into the tubular portion 606 of the tube member 602 by the upper flange 604. The blocking panel redirects some or all of the entering exhaust air laterally through the apertures 608 above the blocking panel in the tubular portion 606 and through the filter panel 622. The receptacle 620, cooperatively with the exhaust passage 616, then redirects the exhaust air through the apertures 608 below the blocking panel back into the tubular portion 606. The exhaust air then passes through the diffuser panel 630 and exits the handle 612 through the apertures 626 in the end cap 624.

Turning now to FIGS. 1-7, the present disclosure provides a muffler assembly including some features similar to those of muffler assembly 600 (FIG. 8), except that the muffler assembly of the present disclosure is configured to substantially changing the air flow through the muffler, thereby significantly improving tool performance. The muffler assembly of the present disclosure, similarly as detailed above with respect to muffler assembly 600 (FIG. 8), is configured for use with a power tool 610. For purposes of brevity, components and features of the muffler assembly of the present disclosure that are similar to that of muffler assembly 600 (FIG. 8), e.g., filter panel 622, diffuser panel 630, and end cap 624, are only summarily described hereinbelow or omitted entirely.

The muffler assembly of the present disclosure includes a muffler tube member 102 defining an upper end and a lower end and having an upper segment 101, a lower segment 103 extending coaxially in a downward direction from the upper segment 101, and a receptacle 120 disposed at the lower end of the lower segment 103. The upper segment 101 is relatively smaller in diameter than the lower segment 103. In particular, the inside diameter of the upper segment 101 is smaller than the inside diameter of the lower segment 103, and the outside diameter of the upper segment 101 is smaller than the outside diameter of the lower segment 103.

An integral (or otherwise engaged) cap 104 extends upwardly from the upper end of the upper segment 101, closing the upper end of the tube member 102. Therefore, unlike the tube member 602 of muffler assembly 600 (see FIG. 8), the tube member 102 is closed at the upper end thereof such that exhaust air must flow around (not through) the top of the tube member 102. To facilitate flow around the top of the tube member 102, at least a portion of the cap 104 is tapered, e.g., frustoconical, transitioning to a larger diameter in the flow direction, i.e., in an upper-to-lower direction. Other tapered configurations are also contemplated. At the end of the cap 104, adjacent the upper segment 101, the cap 104 is larger in diameter than the upper segment 101.

The upper segment 101 includes a vented portion defined by a plurality of elongate circumferential (or partially-circumferential) apertures or vents 108. The vented portion of the upper segment 101 may extend for less than half the total length of the upper segment 101, e.g., about one-third the length of the upper segment 101, and may be disposed at the upper end of the upper segment 101, i.e., adjacent the cap 104. The remaining portion of the upper segment 101, i.e., the lower portion thereof adjacent the lower segment 103, does not include any vents 108, i.e., it defines a continuous cylindrical-shaped surface that prevents exhaust from passing therethrough.

Similarly, the lower segment 103 includes a vented portion defined by a plurality of elongate circumferential (or partially-circumferential) apertures or vents 109. The vented portion of the lower segment 103 may extend for about half the length of the lower segment 103, and may be disposed at the upper end of the lower segment 103, e.g., adjacent the upper segment 101. The remaining portion of the lower segment 103, i.e., the lower portion thereof adjacent the receptacle 120, does not include any vents 109, i.e., it defines a continuous cylindrical-shaped surface that prevents exhaust from passing therethrough.

The receptacle 120 is similar to the receptacle 620 (FIG. 8), and extends downwardly from the lower segment 103. Therefore, the tube member 102 encloses a volume closed at the lower end and defined by the interior of the upper segment 101, the lower segment 103, and the receptacle 120. As each element 101, 103, 120 defining successively larger cross-sectional areas, the volume increases in cross-sectional area in a downward, i.e., upper-to-lower, direction. The volume may also be free from blocking panels such as those detailed above with respect to the tube member 602 (FIG. 8).

The tube member 102 further comprises a plurality of external longitudinal elongate stand-offs or flanges 110, 112 that extend longitudinally from the upper end of the upper segment 101 downwardly to the receptacle 120 at the bottom end of the lower segment 103. The flanges 110, 112 may define a radial dimension that tapers in the lower-to-upper direction such that the flanges 110, 112 extend from the tube member 102 a greater radial distance adjacent the lower end of the tube member 102 as compared to the upper end thereof. Alternatively, flanges 110, 112 may each define a uniform radial dimension along its length.

The tube member 102 is configured to receive the flexible filter panel 622 (FIG. 1), similarly as described with respect to FIG. 8. For example, the filter panel 622 is wrapped about the upper and lower segments 101, 103 of the tube member 102, and may be retained thereon by any convenient mechanism, e.g., an adhesive, latching mechanism (such as a hook-and-loop material), tie wrap, string, wire, or tape that wraps around the panel 622. The panel 622 may also be formed having a generally C-shaped cross-section from a material having sufficient stiffness to retain itself on the tube member 102.

As can be appreciated, the flanges 110, 112 on tube member 102 cause the filter panel 622 to remain spaced apart from the tube member 102, providing channels that define passageways for air between the tube member 102 and the filter panel 622.

The receptacle 120 is sized to fit into the tool exhaust passage 616 and to receive the diffuser panel 630, as discussed above (see FIG. 8).

Figure 1:
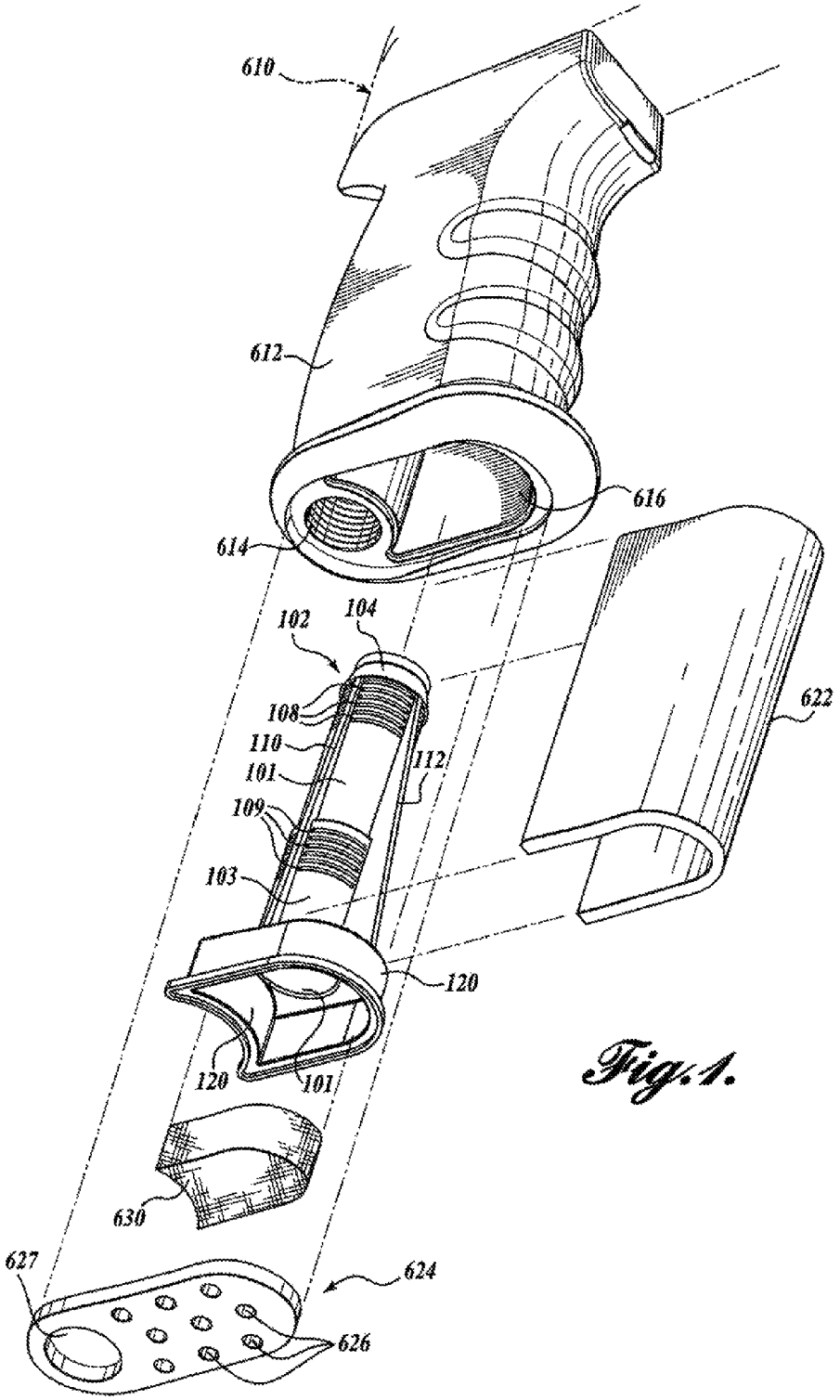
FIG. 1 is a perspective exploded view of a muffler assembly provided in accordance with the present disclosure and configured for use with a handgrip of a power tool.
Figure 2:
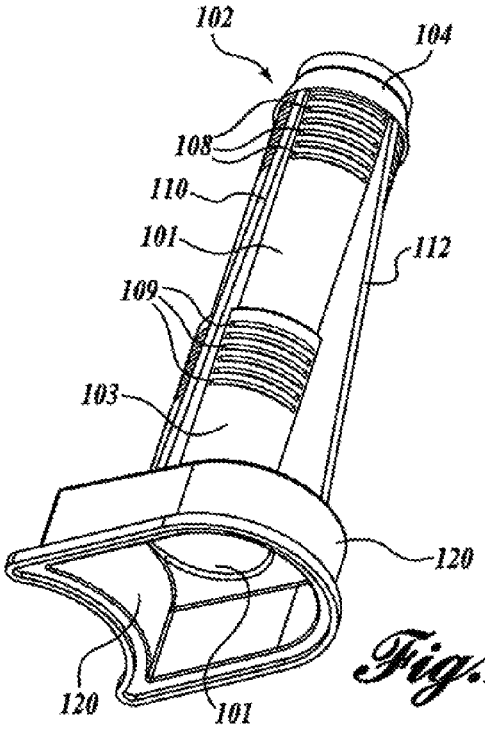
FIG. 2 is a perspective view of a muffler tube member of the muffler assembly of FIG. 1.
Figure 5:
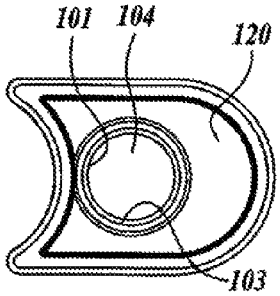
FIG. 5 is a bottom view of the muffler tube member of FIG. 2.
Figure 3:
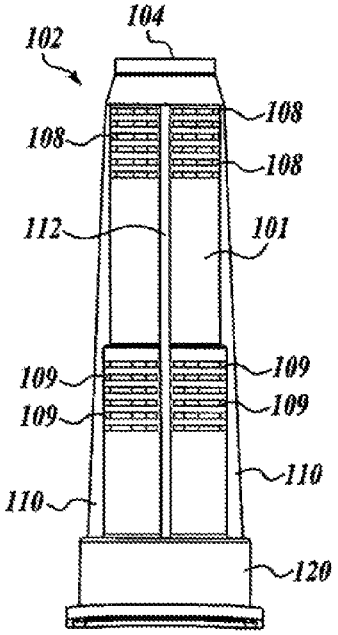
FIG. 3 is a front view of the muffler tube member of FIG. 2.
Figure 4:
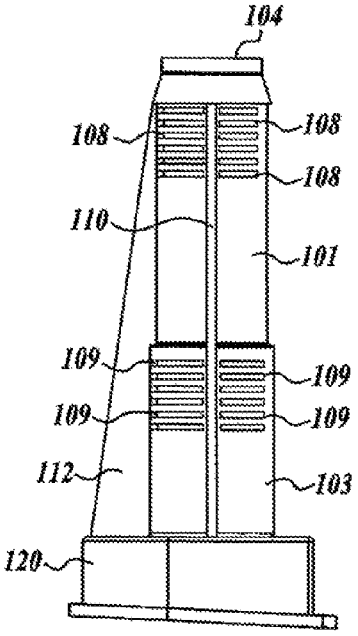
FIG. 4 is a side view of the muffler tube member of FIG. 2.
Figure 6:
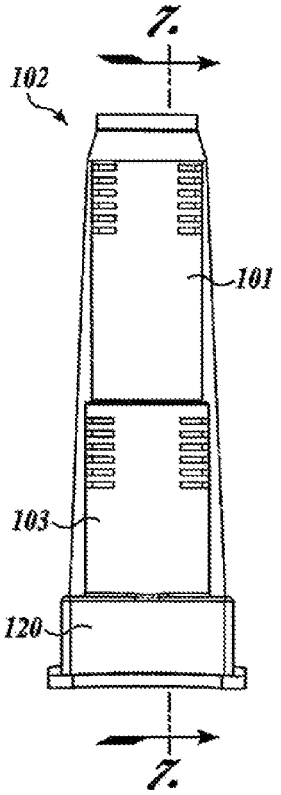
FIG. 6 is a rear view of the muffler tube member of FIG. 2.
Figure 7:
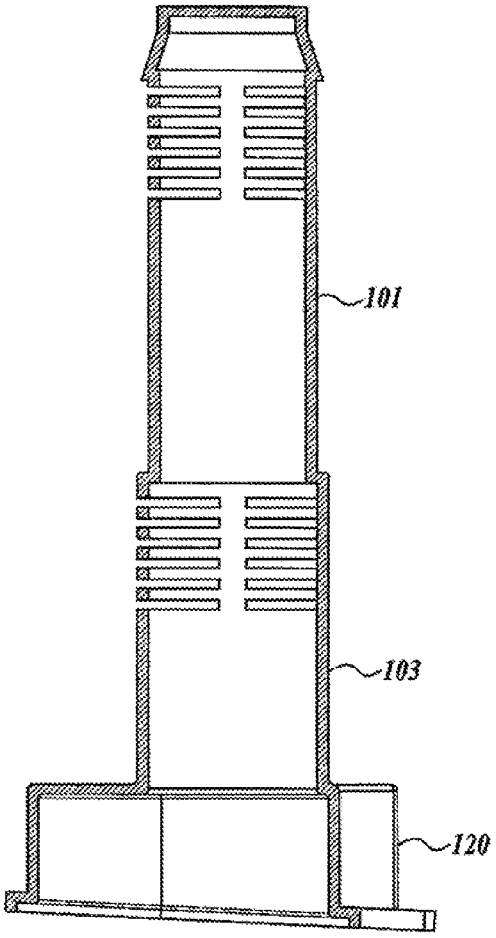
FIG. 7 is a cross-sectional view of the muffler tube member of FIG. 2 taken across section line "7-7" of FIG. 6.

With continued reference to FIGS. 1-7, and to FIG. 1 in particular, the exhaust flow path created via the configuration of the muffler assembly of the present disclosure, detailed above, will now be described. Initially, exhaust air exits the motor (not shown) of the power tool 610 and enters the exhaust passage 616, where it encounters the closed upper end (as defined by cap 104) of the tube member 102. As such, the air flows around the cap 104 and downwardly about the exterior of the tube member 102, with at least a portion of the air flowing into the channels (created via flanges 110, 112) defined between the filter panel 622 and the upper segment 101. A portion of the air enters the vents 108 of upper segment 101 near the upper end of the upper segment 101, while another portion continues downwardly about the unvented cylindrical surface of the upper segment 101. The air flow then encounters the larger-diameter lower segment 103, where the inner flow (through the tube member 102) and outer flow (about the tube member 102) can communicate through the vents 109 defined through the lower segment 103. The channel defined between the tube member 102 and the filter panel 622 is substantially closed at the bottom due to the positioning of receptacle 120, such that most of the air will flow into the vents 109. The air then flows through the diffuser panel 630 in the receptacle 120 and exits the power tool 610 out through the end cap 624.

From the foregoing and with reference to the various figure drawings, those skilled in the art will appreciate that certain modifications can also be made to the present disclosure without departing from the scope of the same. Therefore, the above description should not be construed as limiting, but merely as exemplifications of particular embodiments. Those skilled in the art will envision other modifications within the scope and spirit of the claims appended hereto.

What is claimed is:

1. A muffler assembly for a pneumatic power tool, the muffler assembly comprising:

a tube member defining an interior volume, the tube member including:

an upper segment defining a first diameter, the upper segment including a closed upper end to inhibit fluid communication with the interior volume therethrough, a lower end, a first portion defining a plurality of vents to enable fluid communication with the interior volume therethrough, and a second portion defining a continuous surface to inhibit fluid communication with the interior volume therethrough; and a lower segment defining a second diameter greater than the first diameter, the lower segment including an upper end in fluid communication with the lower end of the upper segment, a lower end, a first portion defining a plurality of vents to enable fluid communication with the interior volume therethrough, and a second portion defining a continuous surface to inhibit fluid communication with the interior volume therethrough.

2. The muffler assembly according to claim 1, further including a filter panel configured to wrap around both the upper and lower segments of the tube member.

3. The muffler assembly according to claim 2, further including at least one flange extending radially outwardly from an exterior surface of the tube member, the at least one flange configured to define a channel between the filter panel and the exterior surface of the tube member.

4. The muffler assembly according to claim 3, wherein the tube member defines a length and wherein the at least one flange extends longitudinally the length of the tube member.

5. The muffler assembly according to claim 1, further including a receptacle disposed at the lower end of the lower segment of the tube member in fluid communication therewith.

6. The muffler assembly according to claim 5, further including a diffuser panel disposed within the receptacle.

7. The muffler assembly according to claim 1, wherein the first portion of the upper segment is positioned towards the upper end of the upper segment and wherein the second portion of the upper segment is positioned towards the lower end of the upper segment.

8. The muffler assembly according to claim 1, wherein the first portion of the lower segment is positioned towards the upper end of the lower segment and wherein the second portion of the lower segment is positioned towards the lower end of the lower segment.

9. The muffler assembly according to claim 1, wherein the first portion of the upper segment extends less than or equal to one-half of a length of the upper segment.

10. The muffler assembly according to claim 1, wherein the first portion of the lower segment extends less than or equal to one-half of a length of the lower segment.

11. A pneumatic power tool, comprising:

a housing having an inlet passage and an exhaust passage; and a muffler assembly configured for insertion into the exhausted passage of the housing, the muffler assembly including:

a tube member defining an interior volume and including:

an upper segment defining a first diameter, the upper segment including a closed upper end to inhibit fluid communication with the interior volume therethrough, a lower end, a first portion defining a plurality of vents to enable fluid communication with the interior volume therethrough, and a second portion defining a continuous surface to inhibit fluid communication with the interior volume therethrough; and a lower segment defining a second diameter greater than the first diameter, the lower segment including an upper end in fluid communication with the lower end of the upper segment, a lower end, a first portion defining a plurality of vents to enable fluid communication with the interior volume therethrough, and a second portion defining a continuous surface to inhibit fluid communication with the interior volume therethrough;

a filter panel configured to wrap around both the upper and lower segments of the tube member;

a receptacle disposed at the lower end of the lower segment of the tube member in fluid communication therewith; and a diffuser panel disposed within the receptacle.

12. The pneumatic power tool according to claim 11, wherein the muffler assembly further includes at least one flange extending radially outwardly from an exterior surface of the tube member, the at least one flange configured to define a channel between the filter panel and the exterior surface of the tube member.

13. The pneumatic power tool according to claim 12, wherein the tube member defines a length and wherein the at least one flange extends longitudinally the length of the tube member.

14. The pneumatic power tool according to claim 11, wherein the first portion of the upper segment is positioned towards the upper end of the upper segment and wherein the second portion of the upper segment is positioned towards the lower end of the upper segment.

15. The pneumatic power tool according to claim 11, wherein the first portion of the lower segment is positioned towards the upper end of the lower segment and wherein the second portion of the lower segment is positioned towards the lower end of the lower segment.

* * * * *